106-99 AU 113 EX
8/29/78 OR 4,110,120

United States Patent [19]

Rosenberg et al.

[11] 4,110,120

[45] Aug. 29, 1978

[54] ANTICORROSION TREATMENT OF GALVANIZED REBARS

[75] Inventors: Arnold Morry Rosenberg, Potomac; James Michael Gaidis, Ellicott City, both of Md.

[73] Assignee: W. R. Grace & Co., New York, N.Y.

[21] Appl. No.: 699,679

[22] Filed: Jun. 28, 1976

[51] Int. Cl.[2] ..... C04B 7/02
[52] U.S. Cl. ..... 106/99
[58] Field of Search ..... 106/99; 148/6.11, 6.2

[56] References Cited

U.S. PATENT DOCUMENTS

| | | | |
|---|---|---|---|
| 2,618,578 | 11/1952 | Kreml | 148/6.11 |
| 3,282,744 | 11/1966 | Goldsmith | 148/6.2 |
| 3,619,441 | 11/1971 | Burchett | 148/6.2 |
| 3,682,718 | 8/1972 | Palm et al. | 148/6.2 |
| 3,755,003 | 8/1973 | Palm et al. | 148/6.2 |

*Primary Examiner*—J. Poer
*Attorney, Agent, or Firm*—Howard Troffkin

[57] ABSTRACT

Improved method of forming zinc chromate on galvanized reinforcing bars comprising treating the bar directly with calcium chromate.

2 Claims, No Drawings

ANTICORROSION TREATMENT OF GALVANIZED REBARS

This invention is directed to an improved method of forming a corrosion resistant coating of zinc chromate on galvanized reinforcing bars imbedded in alite cement.

U.S. Pat. No. 3,210,207, Dodson et al, discloses the use of calcium formate and a chromate salt as a non-corrosive accelerator of set when zinc pieces are included in concrete. The instant invention is an improvement over the Dodson et al invention and involves methods for obtaining the desired coating of zinc chromate on the galvanized reinforcing bars.

Galvanized reinforcing bars tend to corrode at the high pH environment of alite cements. Under such conditions zinc dissolves and forms zincates.

As disclosed by Dodson et al, chromates such as calcium chromate are added directly into the cement prior to imbedding the galvanized reinforcing bars in same. The instant improvement requires that the calcium chromate be applied directly to the surface of the galvanized reinforcing bars. This direct application permits omission of calcium chromate from the alite cement per se, thereby reducing the amount of calcium chromate required, and concentrating calcium chromate in the desired locus, i.e., on the zinc surface. Calcium chromate reacts with zinc to form zinc chromate, as a protective coating which is substantially insoluble in the alite cement matrix.

The binder component in the cements, mortars and concretes used widely as a construction material is portland cement. Portland cement is manufactured by calcining a mixture of limestone and clay to form a clinker, and by grinding the clinker to a fine powder. The major compounds found in portland cement are tricalcium silicate, dicalcium silicate, tricalcium aluminate, and tetracalcium aluminoferrite. The tricalcium and dicalcium silicates are thought to be the principal bonding constituents in the portland cement. Tricalcium silicate, when mixed with water, forms a calcium silicate hydrate known as tobermorite gel and calcium hydroxide. The dicalcium silicate, when contacted with water, forms similar products but at a much lower rate of reaction. The tricalcium silicate, having the greater rate of reaction determines, to a large extent, the hardening rate of the cement. To provide materials which are suitable for different uses, portland cements having a range of hardening rates have been found desirable. By producing cements having a range of proportions of tricalcium silicate present, a range of hardening rates and strength development has been obtained. Four general types of portland cements, varying principally in the relative quantities of tricalcium silicate and dicalcium silicate present therein, are commonly produced. The proportions of the principal compounds present in each type of cement are shown in Table I.

TABLE I

| Cement type | I | II | III | IV |
|---|---|---|---|---|
| Composition, wt. percent: | | | | |
| Tricalcium silicate | 53 | 47 | 58 | 26 |
| Dicalcium silicate | 24 | 32 | 16 | 54 |
| Tricalcium aluminate | 8 | 3 | 8 | 2 |
| Tetracalcium aluminoferrite | 8 | 12 | 8 | 12 |

The term "alite cement" is defined as including neat pastes, mortars, and concretes and the mixed, dry unreacted ingredients of neat pastes, mortars, and concretes, comprising as alite cement binder, a composition containing greater than 20 percent tricalcium silicate based on the dry weight of the composition. The most common alite cements are portland cements, and mortars and concretes containing portland cements. Most commercially available alite cements contain binders comprising from about 20 to 75 percent tricalcium silicate. The alite cement binder, or concrete binder, is the component which provides the desired bonding, for example, portland cement.

Alite cements encounter various corrosion environments. In some, the environment is an inherent part of the cement, e.g., as by use of calcium chloride accelerator, or the use of chloride containing materials. Other environments may be extraneous, e.g., use of calcium chloride and/or salt in snow and ice removal, exposure to salt spray or brines, and the like. Such environments tend to attack and corrode metal pieces within or in contact with the alite cement. The instant invention provides coatings for the metal that we believe inhibit such corrosion.

The following examples illustrate without limiting the invention.

EXAMPLE 1

An embodiment which, on information and belief, is considered operable, is simple immersion of the galvanized reinforcing bar (rebar) in an aqueous solution of calcium chromate, followed by withdrawal and optional drying. If the rebar is to be stored and/or shipped, it is preferable to dry same. This can be done by simple standing. On the other hand, if the situs of immersion is near the work, then there is no need to dry the rebar. Another method of application is to affix the rebars in place and then spray same with a solution of calcium chromate through a hose.

EXAMPLE 2

Another method of treating galvanized rebars with calcium chromate is to melt the calcium chromate followed by insertion of the rebar into the molten chromate. Zinc chromate forms very rapidly, with the formation of a by-product, calcium oxide.

Associated Systems of Corrosion Control

The calcium chromate-treated rebars of this invention can be used in association with many standard systems of corrosion control, including powder epoxy coatings; polymer-impregnated concrete; waterproof membranes; dense concrete, low water-cement ratio and superplasticizers; integral addition of wax beads; expansive cements; fly ash; latex modified mortar topping; inorganic polymer addition; and polymer concrete. (Examples of suitable latices for latex modified mortar topping are acrylic, polyvinyl acetate, polyvinyl alcohol, vinylidene chloride, styrene-butadiene, and copolymers of these.)

Mixtures

Any of the above mentioned systems should work quite well in concert with the calcium chromate-treated rebars of this invention. However, special mention should be made of certain of these. The first case is methods of treating concrete that would reduce the water permeability. In these cases a harsh mix with a low water/cement ratio would tend to make the treated rebars more corrosion resistant. However, because of the placing difficulties with a harsh mix an admixture could be used to reduce the water and maintain the same plasticity of the mix. In these cases a plasticizer could be used such as copolymers of naphthalene fomaldehyde resins or the more normally used water reducing agents such as 80% calcium lignosulfonate and 20% triethylamine added at an addition rate of 0.1 to 0.4 percent s/s cement.

Use with Water Reducing Agents

A water reducing agent is a material added to cement during the manufacture of the concrete to improve the placeability or workability of the mix which allows normal hardening of the concrete to take place, which eventually produces 28-day strengths that are at least 10% stronger than the mix not containing the admixture. Generally a reducing agent causes 5% or greater reduction of water in the mix. Water reducing agents are described in ASTM C-494.

A preferred formulation using the calcium chromate-treated galvanized rebars of this invention involves a water reducing agent. There are at least two reasons for this. In the first place an ordinary mix making a water reducing agent may tend to form large random bubbles against reinforcing rods during placement of the concrete or cement. Our experimental work shows that the surface of the reinforcing rod exposed to such large random bubbles shows aggravated corrosion, as compared to surfaces of the rod not in contact with such bubbles. In the second place the use of such water reducing agents results in the formation of a more dense cement or concrete, and in consequence reduces ingress of corrosive salts from the environment.

A preferred water reducing agent is 80% calcium lignosulfonate and 20% calcium chloride added at an addition rate of 0.1 to 0.4 per cent. Other water reducing agents include additives such as triethylamine formate or polysaccharides.

Use with Retarders

As is known in the cement art, sodium gluconate, calcium lignosulfonate, saccharide type materials and the like, have a known characteristic of improving the placeability and strength as well as retarding the set of the concrete mix. Hence simply by the use of any of the standard retarders, the corrosion control properties of our calcium chromate-treated rebars should be enhanced. Retarders are generally added at 0.05 to 0.4% based on solid cement.

Use with Air Entraining Agents

Air entraining agents are added to concrete to improve durability. They work by providing small expansion chambers within the concrete mix such that when water freezes within the concrete, concrete does not spall and crack. When an air entraining agent is used the mean free path for the introduction of corrosive chloride into the concrete is kept to a maximum, reducing the chloride concentration at the surface of the calcium chromate-treated galvanized reinforcing bar, thereby further inhibiting corrosion of the rebar.

As an air entraining agent Vinsol Resin sold commercially by Hercules Powder Co. is recommended. This material is of the family of wood rosins. Also suitable are saponified tall oil resins and sodium lauryl sulfonate (this being an anionic surfactant) and "TRITON X100" (this being a nonyl phenol ethylene oxide condensate, a nonionic surfactant).

Use with Accelerators

The treated rebars of this invention can be used in alite cements using accelerators in any of the formations herein described. Such accelerators are well known to those skilled in the cement and concrete art and are listed in standard texts on this subject.

Use with Pozzolans

These materials, whether natural or artificial (e.g., fly ash, blast furnace slag, and the like) are useful with the treated rebars of this invention in that these added materials fill up voids in the concrete and/or cement mix, thereby enhancing further the corrosion-resisting properties of the coated rebars. A concrete mix containing 20% of the cement replaced by fly ash is useful, other constituents in the concrete mix being unchanged except that this mix will require cold water because of the added pozzolans.

All statements herein are made on information and belief.

What is claimed is:

1. An article of manufacture comprising an alite cement matrix containing galvanized reinforcing bars treated by contacting the galvanized reinforcing bars with a composition consisting essentially of calcium chromate.

2. The article of claim 1 in which the bars are contacted with a composition consisting essentially of molten calcium chromate.

* * * * *